US005669639A

United States Patent [19]

Lawrence

[11] Patent Number: 5,669,639

[45] Date of Patent: Sep. 23, 1997

[54] WINDOW LATCH MECHANISM

[76] Inventor: Barry G. Lawrence, P.O. Box 846, Thomasville, N.C. 27360

[21] Appl. No.: 647,288

[22] Filed: May 9, 1996

[51] Int. Cl.[6] ..... E05C 1/10

[52] U.S. Cl. ..... 292/175; 292/337; 292/DIG. 47; 49/175

[58] Field of Search ..... 292/175, DIG. 47, 292/137, 145, 163, 337; 49/449, 450, 175

[56] References Cited

U.S. PATENT DOCUMENTS

| | | | |
|---|---|---|---|
| D. 268,643 | 4/1983 | Anderson . | |
| 543,226 | 7/1895 | Atwood | 292/175 |
| 907,525 | 12/1908 | Rapson | 292/175 |
| 1,724,116 | 8/1929 | Swearengin | 292/175 |
| 2,768,852 | 10/1956 | Hicks | 292/337 X |
| 4,061,370 | 12/1977 | Hauber | 292/175 |
| 4,578,903 | 4/1986 | Simpson . | |
| 4,818,000 | 4/1989 | Bobrowski | 292/337 X |
| 4,901,475 | 2/1990 | Simpson . | |
| 5,096,240 | 3/1992 | Schultz . | |
| 5,104,165 | 4/1992 | Anderson et al. | 292/337 |
| 5,139,291 | 8/1992 | Schultz . | |
| 5,248,174 | 9/1993 | Matz . | |
| 5,251,401 | 10/1993 | Prete et al. . | |
| 5,301,989 | 4/1994 | Dallmann et al. | 292/337 X |
| 5,371,971 | 12/1994 | Prete . | |

FOREIGN PATENT DOCUMENTS

| | | | |
|---|---|---|---|
| 1282044 | 12/1961 | France | 292/337 |
| 1043863 | 11/1958 | Germany | 292/175 |

*Primary Examiner*—Rodney M. Lindsey

[57] ABSTRACT

A latch mechanism is provided for a window which includes a top section and a bottom section with a surrounding groove therebetween. The groove may be varied in size depending on the particular sash header or base slot rail utilized. Different bottom sections can be employed which have flexible side walls of different heights to increase the versatility of the latch mechanisms. Tilt latch mechanisms can also be manufactured formed of a variety of different materials, with a variety of bottom sections having different side wall heights, some of which may be flexible.

14 Claims, 3 Drawing Sheets

WINDOW LATCH MECHANISM

BACKGROUND OF THE INVENTION

1. Field of the Invention

The invention herein pertains to latches and particularly to latches for use on double-hung windows to selectively lock the sashes in any of a variety of positions. Also, the latch mechanism constructions as shown herein can be utilized for latches that allow the windows to be tilted for cleaning or removal purposes.

2. Description of the Prior Art and Objectives of the Invention

In recent years more and more manufacturers have entered the window market and particularly the market for double-hung windows as used in homes and other buildings. Such manufacturers or shops generally purchase their hardware such as latches, pivot latches, locks and the like from outside sources. Once the dimensions and setups in window shops have been established hardware manufacturers are often foreclosed since their hardware may have dimensions slightly different from the window manufacturers requirements and thus hardware substitutions are difficult. Also, homeowners and maintenance men have difficulty in finding the exact hardware replacement for a particular window and oftentimes must modify or exchange a header or frame stile in order to use different hardware. This is of particular concern regarding window latches and pivot latches which must fit specific header slot configurations. While many window manufacturers use substantially the same hardware and window manufacturing techniques, a slight dimension change in the hardware of only a few millimeters can allow or prevent substitution of hardware.

Thus, with the known problems and difficulties associated with installation and/or replacement of conventional window hardware, the present invention was conceived and one of its objectives is to provide window latch mechanisms and pivot latch mechanisms which can be used in a variety of window header and stile slots having different size rails.

It is another objective of the present invention to provide a latch mechanism which can be manufactured with different height flexible bottom side walls to accommodate different header slot rail sizes.

It is still another objective of the present invention to provide a latch bottom section which can be used on either standard latch assemblies or pivot latch assemblies as used in double hung windows.

It is also an objective of the present invention to provide a window latch mechanism which is relatively easy to manufacture and which is low in cost.

It is still a further objective of the present invention to provide a window utilizing the latch mechanisms as described herein.

It is also an objective of the present invention to provide a window in which only one routing (slot) size is used on all four corners of a window sash.

It is an additional objective of the present invention to present a slide-in tilt latch which is spring-loaded.

Various other objectives and advantages of the present invention will become apparent to those skilled in the art as a more detailed description is set forth below.

SUMMARY OF THE INVENTION

A window latch mechanism of the aforesaid description may be formed from suitable plastic and includes a top section, a latch bolt with spring and a bottom section having side walls which can be factory assembled and shipped to various window manufacturers. The bottom section is formed from plastic and can be manufactured with a variety of side wall heights to accommodate the header rail thicknesses of, for example, latch slots of various window manufacturers. The side wall height of the bottom section determines the groove size of the latch mechanism and if the bottom side wall height is lowered, a larger groove is provided to accommodate a thicker or wider header rail. In addition to standard window latches, spring-loaded window pivot latches can also be manufactured of either metal, plastic or combinations thereof, in the same manner using bottom sections having different side wall heights for different slot rail thicknesses.

In addition to the bottom section side wall height differences, a difference in the side walls of the bottom section can be formed of thin, flexible plastic which will allow the side walls to pivot downwardly or outwardly for further versatility in accommodating different size or thickness header notch rails.

DESCRIPTION OF THE PREFERRED EMBODIMENT

Figure 1:
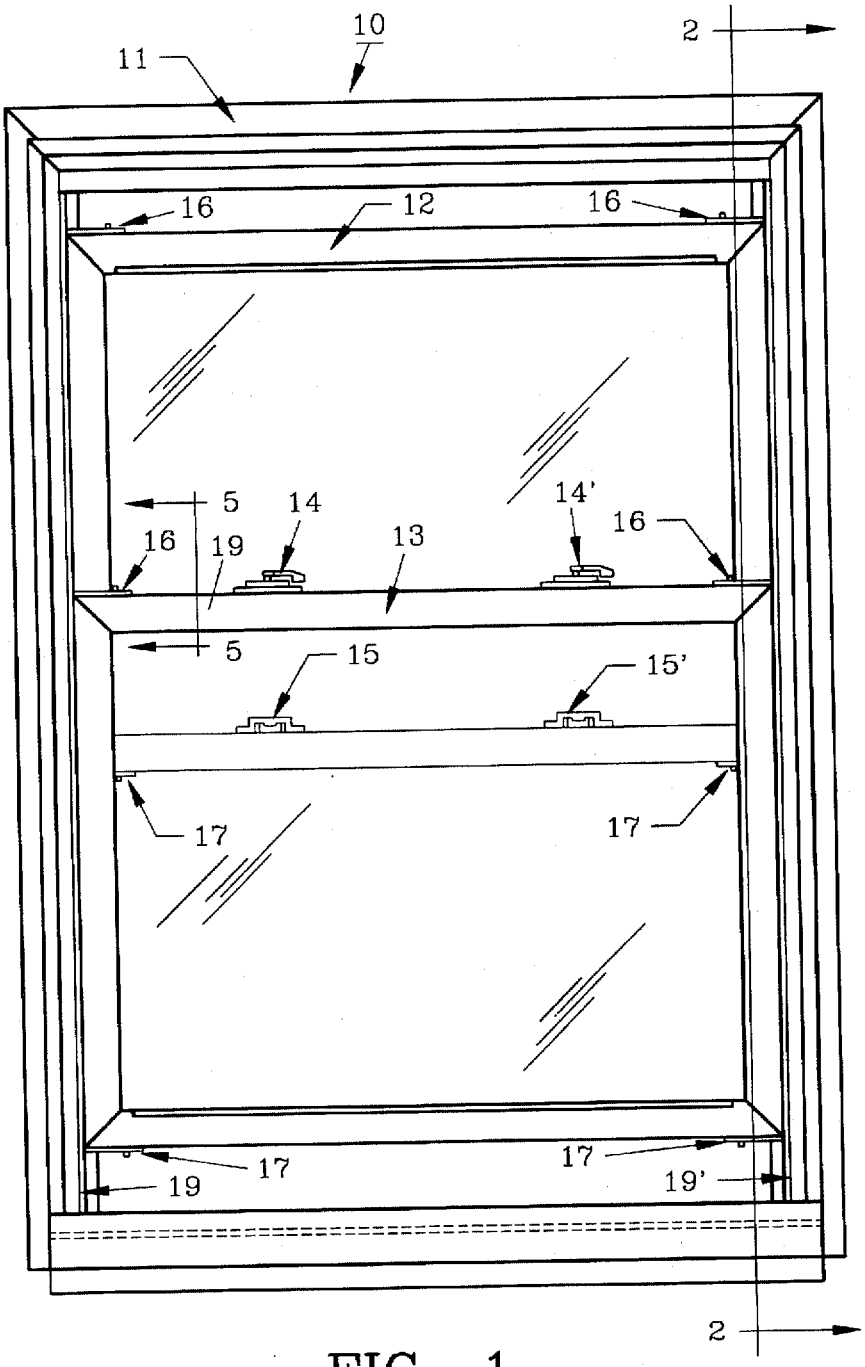
FIG. 1 demonstrates a double hung window with the latch mechanisms of the invention affixed thereto.

The preferred form of the window as described herein is shown in FIG. 1 with an upper and a lower sash slidably mounted within a surrounding rectangular frame. Left and right latch mechanisms are affixed to both the top sash header and the lower sash header to allow the sashes to be selectively opened. Pivot latches are affixed to the upper and lower sash bases for use during cleaning or sash removal.

Figure 14:
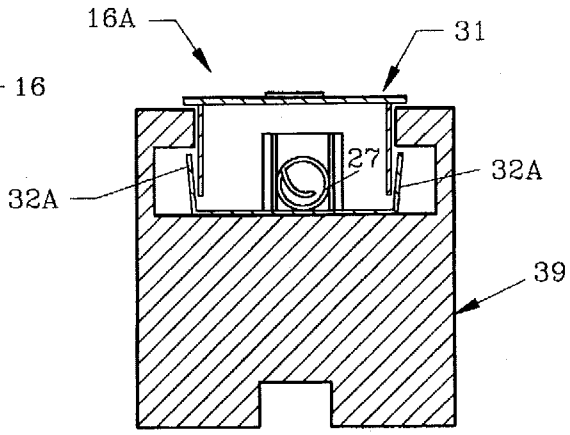
FIG. 14 depicts a cross-sectional end view of the latch mechanism of FIG. 13 with the side walls seen pivoted downwardly and outwardly.
Figure 7:
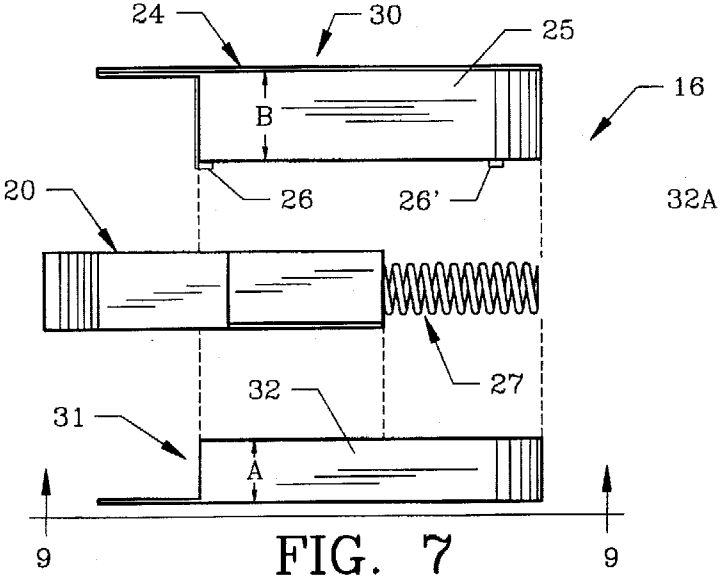
FIG. 7 shows an exploded side view of the latch mechanism as seen in FIG. 5.
Figure 13:
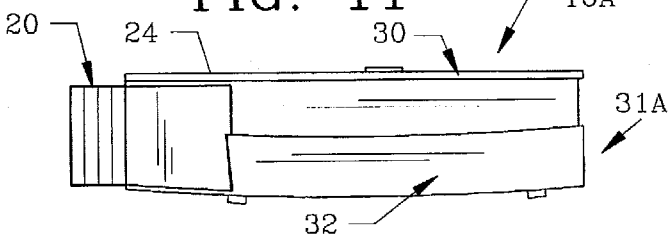
FIG. 13 shows a side view of the assembled latch mechanism as seen in FIG. 11 with the side walls pivoted downwardly to allow a larger rail to fit therein.

The preferred latch mechanism of the invention is shown in FIGS. 1 and 7 and includes a top section, a latch bolt and coil spring and a bottom section. The bottom section, like the top section, has side walls. The bottom section side walls are shorter than the top section side walls to form a gap between the upper edge or top of the side walls and the lower surface of the top for receiving a header or base slot rail therebetween. Various bottom sections can be manufactured with different side wall heights to thereby vary the slot size for accommodating a wide variety of slot rails of different manufacturers. Also, in the preferred embodiment, the lower section side walls are formed of a relatively flexible plastic to allow the side walls to pivot downwardly and outwardly as shown in FIGS. 13 and 14 to accommodate even a wider variety of slot rail sizes.

DETAILED DESCRIPTION OF THE DRAWINGS AND OPERATION OF THE INVENTION

For a better understanding of the invention and its operation, turning now to the drawings, FIG. 1 demonstrates a double hung window 10 having an outer frame 11 with a slidable upper sash 12 and slidable lower sash 13. As would be understood, upper sash 12 and lower sash 13 move within frame 11 and can be locked in a closed position by lock levers 14, 14' on lower sash 13, which engage catches 15, 15' on upper sash 12 when both sashes are closed. To open sashes 12, 13 only a selected degree after unlocking, while preventing further movement, latch mechanisms 16 are provided. To tilt sashes 12, 13 for cleaning or removal purposes, tilt latch mechanisms 17 are installed on each side of the lower stiles of sashes 12, 13. Conventional keeper hardware is not shown herein for tilt latch mechanism 17 or window latch mechanism 16.

Figure 2:
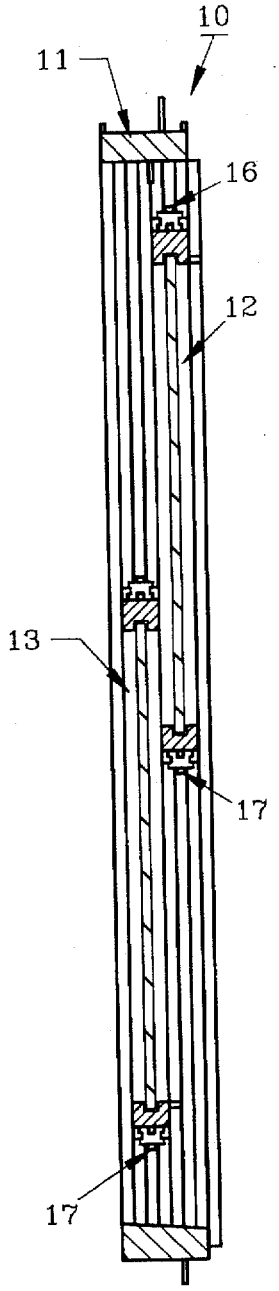
FIG. 2 shows a side view of the window as shown in FIG. 1 along lines 2—2.
Figure 3:
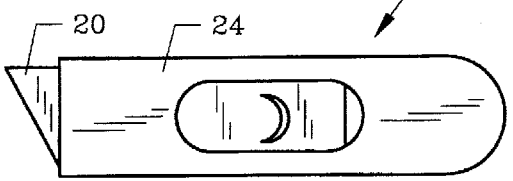
FIG. 3 illustrates a top view of a window latch mechanism of the invention.
Figure 4:
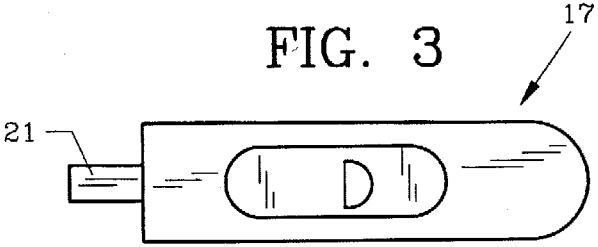
FIG. 4 pictures a top view of a pivot latch mechanism of the invention.

In FIG. 2, the placement of latch mechanism 16 and tilt latch mechanism 17 are shown on sashes 12, 13 within outer frame 11. As further shown in FIGS. 3 and 4, latch mechanism 16 provides a biased latch bolt 20 whereas tilt latch mechanism 17 provides a substantially rectangular-shaped latch bolt 21. Latch bolts 20, 21 engage conventional keepers (not shown) in window side rails, 19, 19' in FIG. 1 which are old and well known in the window art having various sizes and configurations as required.

Pivot latch mechanism 17 has a manual retractable pivot bolt 21 for retraction when desirous to pivot or remove a sash. Thus, pivot latch mechanism is constructed as shown in FIG. 7, with the exception of the latch bolt, which does not have a biased end. Tilt latch 17 shown in FIG. 4 may have its bottom section formed from metal such as cast zinc or suitable plastics, depending on the particular application and cost considerations. Bolt 21 as seen is rectangular, but may be cylindrically shaped. Tilt latch 17 may be of the same overall size as latch mechanism 16, so only one size slot need be routed at each corner of the window with uniform rail size for production efficiency.

Figure 8:
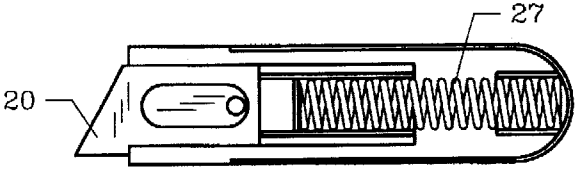
FIG. 8 illustrates a top view of the latch mechanism as shown in FIG. 7 partially assembled, with the top removed.
Figure 5:
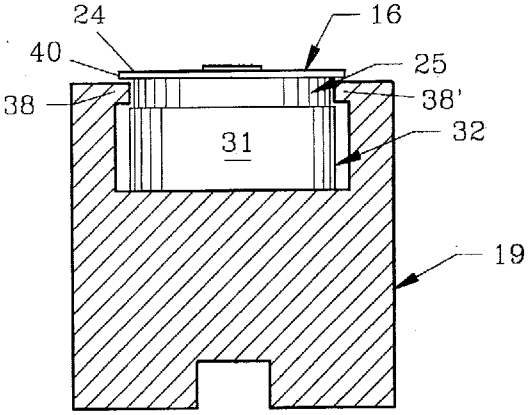
FIG. 5 depicts a cross-sectional view of a section of the header of FIG. 1 as seen along lines 5—5.
Figure 6:
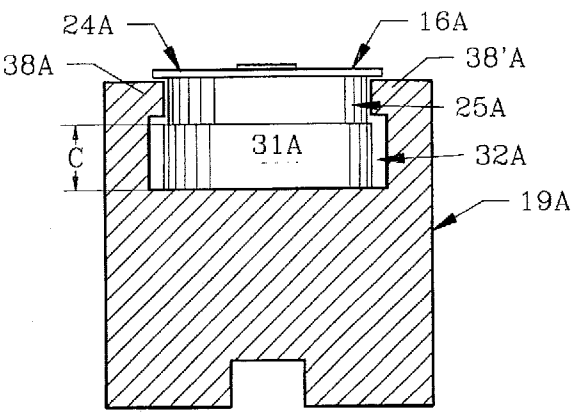
FIG. 6 demonstrates an alternate header and latch mechanism of that seen in FIG. 5.

Header 12 as seen in FIG. 1, illustrates the positioning of latch mechanism 16 used thereon. As seen, top 24 (FIG. 3) of latch mechanism 16 extends above the top of header 12 whereby the side walls 25 (FIG. 7) are inwardly of the edges 40 of top 24 as seen in FIG. 5. Latch mechanism 16 as shown in FIG. 7 includes top section 30 having top 24, side walls 25 and attaching members 26, 26' all formed from plastic. Biased latch bolt 20 is joined to coil spring 27 as shown in FIG. 8. Bottom section 31 includes side walls 32 which have a height A which is less than height B of top section side walls 25. This difference in height as shown in FIGS. 5, 13 provides a gap between top 24 and bottom side walls 32, thereby allowing header rails 38, 38' to secure latch mechanism 16 therein. In FIG. 6, an alternate latch mechanism 16A is shown in which top section side walls 25A have the same length B as shown in FIG. 7 of latch mechanism 16. However, side walls 32A have a height C less than height A of side walls 32 as shown in FIG. 7 to thereby form a wide groove or gap between top 24A and bottom section 31A as required for header 19A which includes taller rails 38A and 38'A as shown in the cross-sectional areas of FIG. 6.

Figure 9:
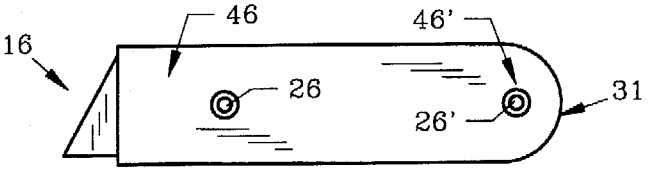
FIG. 9 pictures a bottom view of the latch mechanism assembled as seen in FIG. 7 along lines 9—9.

Studs 26, 26' seen in FIG. 7 are attached to top section 30 and are inserted into openings 46, 46' of bottom section 31 as shown in FIG. 9. Studs 26, 26' are formed of thermoplastic and can be heat welded or swaged to secure latch mechanism 16 in assembled form.

Figure 10:
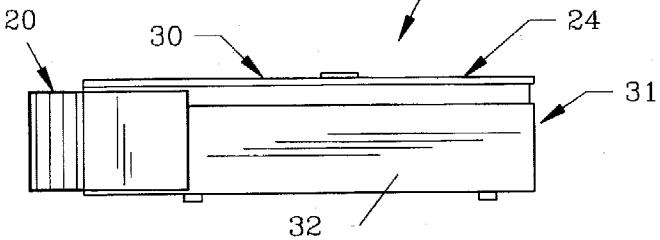
FIG. 10 features a side view of the assembled latch mechanism as seen in FIG. 7.
Figure 11:
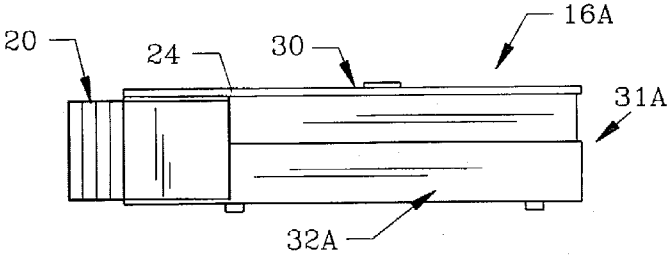
FIG. 11 provides a side view of an alternate embodiment of the latch mechanism.
Figure 12:
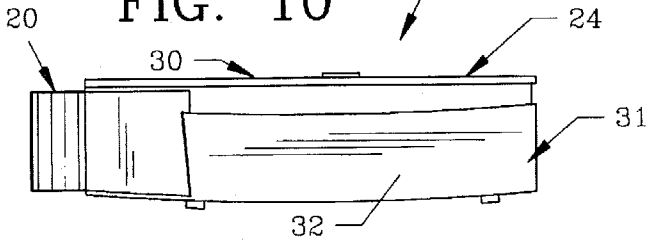
FIG. 12 demonstrates the latch mechanism of FIG. 10 with the side walls pivoted downwardly to allow a larger rail to fit therein.

In order to simplify manufacturing and to maintain competitive costs for latch mechanisms 16, 17, a variety of bottom sections can be made having different side wall heights. Thus, the same top section 30, latch bolt 20 and coil spring 27, as seen in FIG. 7, can be utilized with a series of bottom sections such as 31 or 31A (FIGS. 10, 11), depending on the particular header utilized. In addition, latch mechanism 16 can be further adjusted for placement in different header configurations and rail sizes by the flexibility of side walls 32, 32A as shown in FIGS. 12 and 13. As seen, side walls 32 on both the left and right sides are shown pivoted downwardly in these schematic representations. Outward pivoting action occurs as seen in FIG. 14 as the side walls pivot downwardly as seen somewhat exaggerated in FIGS. 12 and 13. This allows bottom sections 31 or 31A to fit even a greater variety of window header or base slot configurations as the pivoting motion of side walls 32, 32A effectively reduces the height of the side walls and increases the gap between side walls 32, 32A and top 24. For pivoting action, a flexible plastic is preferred as the material of choice.

Thus, as shown described, latch mechanisms 16, 17 can be varied by the use of different bottom sections as shown in FIGS. 5 and 6 for fitting different rail sizes and can be further varied by the use of both metal and plastic components.

The illustrations and examples provided herein are for explanatory purposes and are not intended to limit the scope of the appended claims.

I claim:

1. A latch mechanism comprising: a housing, a slidable latch contained within said housing, said housing comprising a top section, a bottom section, said bottom section comprising a base, side walls, said side walls attached substantially perpendicularly to said base, said top section comprising a top, an edge, said edge surrounding said top, side walls, said side walls attached substantially perpendicularly to said top inwardly of said top edge, and said top section side walls placed within said bottom section side walls.

2. The latch mechanism of claim 1 wherein said bottom section side walls are shorter than said top section side walls to form a groove between said bottom section side walls and said top.

3. The latch mechanism of claim 1 wherein said bottom section side walls are pivotable.

4. The latch mechanism of claim 1 wherein said bottom section is formed from plastic.

5. The latch mechanism of claim 1 wherein said bottom section side walls and said top forms a groove therebetween.

6. The latch mechanism of claim 1 further comprising a spring, said spring contacting said latch to bias the same.

7. The latch mechanism of claim 1 wherein said latch mechanism comprises a window sash latch mechanism.

8. The latch mechanism of claim 1 wherein said latch mechanism comprises a window sash tilt latch mechanism.

9. A window sash latch mechanism for use in a double-hung window within a frame, the mechanism comprising a latch and a spring, said spring contacting said latch, within a two-piece housing, said housing having a top section attached to a bottom section, said latch mechanism positioned within said housing to prevent sash movement within the frame, said top housing section comprising a substantially planar top, an edge, said edge surrounding said planar top, side walls, said side walls affixed substantially perpendicularly to said planar top interiorly of said top edge, said bottom section comprising a base, bottom side walls, said bottom side walls affixed to said base, said top side walls positioned within said bottom side walls, said top side walls contiguous to said base, said bottom side walls spaced from said top to form a groove on said latch mechanism between said top and said bottom side walls.

10. The window sash latch mechanism of claim 9 wherein said bottom side walls are pivotally attached to said base.

11. The window sash latch mechanism of claim 9 wherein said top side walls are longer than said bottom side walls.

12. The window sash latch mechanism of claim 9 wherein said housing bottom section is formed from plastic.

13. A window latch for positioning in a slidable window sash having a header and a pair of header rails, said window latch comprising:

(a) a top section, said top section comprising a top, an edge, said edge surrounding said top, and a pair of opposing, substantially planar side walls joined perpendicularly to said top, inwardly of said top edge;

(b) a bottom section, said bottom section comprising a base and a pair of opposing substantially planar side walls being joined perpendicularly to said base, said bottom section side walls having height less than the height of said top section side walls to define a groove between said top and bottom sections, said groove for engaging the header rail of the window sash, said bottom section side walls being pivotable relative to said base to adjust the width of said groove;

(c) a latch bolt positioned between said top and said bottom sections; and (d) a spring joined to said latch bolt.

14. The window latch of claim 13 wherein said bottom section is formed from plastic.

* * * * *